US005504290A

United States Patent [19]

Baginski et al.

[11] Patent Number: 5,504,290

[45] Date of Patent: Apr. 2, 1996

[54] REMOTE CONTROLLED CIRCUIT BREAKER WITH RECHARGING CAM

[75] Inventors: Pierre Baginski, Grenoble; Jean-Pierre Nebon, St. Martin le Vinoux, both of France

[73] Assignee: Merlin Gerin, France

[21] Appl. No.: 191,535

[22] Filed: Feb. 4, 1994

[30] Foreign Application Priority Data

Feb. 16, 1993 [FR] France ..... 93 01822

[51] Int. Cl.[6] ..... H01H 5/00

[52] U.S. Cl. ..... 200/401; 200/330; 200/331; 200/332.1; 200/337; 200/400

[58] Field of Search ..... 200/400, 401, 200/330, 331, 332, 332.1, 337, 303

[56] References Cited

U.S. PATENT DOCUMENTS

| | | | |
|---|---|---|---|
| 4,713,508 | 12/1987 | Baginski et al. | 200/400 |
| 4,873,404 | 10/1989 | Fretsch | 200/401 |
| 4,901,821 | 2/1990 | Robbins | 185/40 R |
| 5,288,958 | 2/1994 | Grunert et al. | 200/331 |

FOREIGN PATENT DOCUMENTS

| | | |
|---|---|---|
| 0080636 | 6/1983 | European Pat. Off. . |
| 0222645 | 5/1987 | European Pat. Off. . |
| 0427641 | 5/1991 | European Pat. Off. . |
| 0473244 | 3/1992 | European Pat. Off. . |

*Primary Examiner*—Henry J. Recla
*Assistant Examiner*—David J. Walczak
*Attorney, Agent, or Firm*—Parkhurst, Wendel & Rossi

[57] ABSTRACT

A remote controlled circuit breaker including a mechanism linked to a handle by a drive lever equipped with a roller cooperating with a recharging cam of an energy storage system including a spring. A bearing surface is arranged to block the roller in the charged position, without requiring the presence of a special latching stage, since the line of action of the reaction R of the roller passes via the transmission shaft of the cam. A step-by-step motor of the vibrating type drives the transmission shaft in rotation, and enables almost instantaneous stopping of the cam when the roller is in contact with the bearing surface.

10 Claims, 9 Drawing Sheets

REMOTE CONTROLLED CIRCUIT BREAKER WITH RECHARGING CAM

BACKGROUND OF THE INVENTION

The invention relates to a remote controlled circuit breaker formed by assembly of a remote control unit and a multipole circuit breaker with insulating case, the circuit breaker housing:

- a first toggle mechanism associated with an automatic trip device, and with an operating handle,
- a system of separable contacts per pole, actuated by a switching bar mechanically connected to the first mechanism, the remote control unit being able to be adjoined to the front panel of the case and comprising:

- a transmission rack in which the handle of the circuit breaker engages,
- a second mechanism connected to the transmission rack by a drive lever, and equipped with a recharging cam driven by a geared motor device or by an emergency manual control, to store mechanical energy in at least one closing spring, said cam having a first charging sector, and a second sector for releasing a roller securedly united to the drive lever.

Resetting mechanisms making an operating cam and a drive lever roller cooperate are well-known in the art to perform actuation of a closing spring in the compression and relaxation direction. A device of this kind is illustrated in the document EP-A-222,645, in which a special latching stage maintains the cam of the mechanism in the charged state. The latching stage comprises for this purpose a closing ratchet associated with a half,moon locking bolt, which is controlled either manually by a pushbutton or electrically by excitation of a tripping electromagnet. The presence of the ratchet is indispensable, because of the counteraction of a disequilibrium torque on the cam, the torque resulting from the tension of the spring and the angle formed by the reaction of the roller on the cam, and the line passing via the roller and the cam spindle. Such a device is complicated to achieve, and increases the cost price of the mechanism.

The object of the invention consists in improving a remote control mechanism for a multipole circuit breaker.

SUMMARY OF THE INVENTION

The remote controlled circuit breaker is characterized in that the recharging cam comprises a bearing surface shaped to stabilize the roller in the charged position of the drive lever due to the passage of the line of action of the reaction R of the roller by the transmission shaft of the recharging cam, and that the geared motor is provided with means for achieving an almost instantaneous stopping of the recharging cam when the roller reaches the vicinity of the bearing surface.

The charged position of the roller on the bearing surface of the cam is stable and no driving force is exerted on the cam, since the reaction of the cam is aligned with the line passing via the roller and the cam shaft. A special locking ratchet is therefore not necessary to maintain the cam in equilibrium. It is also possible to eliminate the closing electromagnet, since the electrical closing order is applied directly to the geared motor. The structure of the second mechanism is thus simplified.

Opening of the circuit breaker, and energy storage in the closing spring are achieved by means of the cam and roller assembly, the cam shaft being actuated electrically by the geared motor device, or manually by the emergency control. High-speed closing of the circuit breaker results from passing a hangup point of the roller on the cam, the latter being actuated electrically by the geared motor device or manually by means of a closing pushbutton.

The shape of the bearing surface of the charging cam is flat or curved.

The use of a motor of vibrating type enables an instantaneous stopping of the charging cam to be achieved in the charged position.

According to one feature of the invention, the second mechanism is provided with a first manual closing pushbutton cooperating with means for moving the recharging cam to the discharged position, in which the roller is close to the second sector enabling high-speed relaxation of the closing spring.

According to another feature of the invention, the second mechanism is provided with a second manual opening pushbutton cooperating with a tripping pushrod of the first mechanism.

BRIEF DESCRIPTION OF THE DRAWINGS

Other advantages and features will become more clearly apparent from the following description of an illustrative embodiment of the invention, given as a non-restrictive example only and represented in the accompanying drawings, in which.

DETAILED DESCRIPTION OF THE PREFERRED EMBODIMENT

Figure 1:
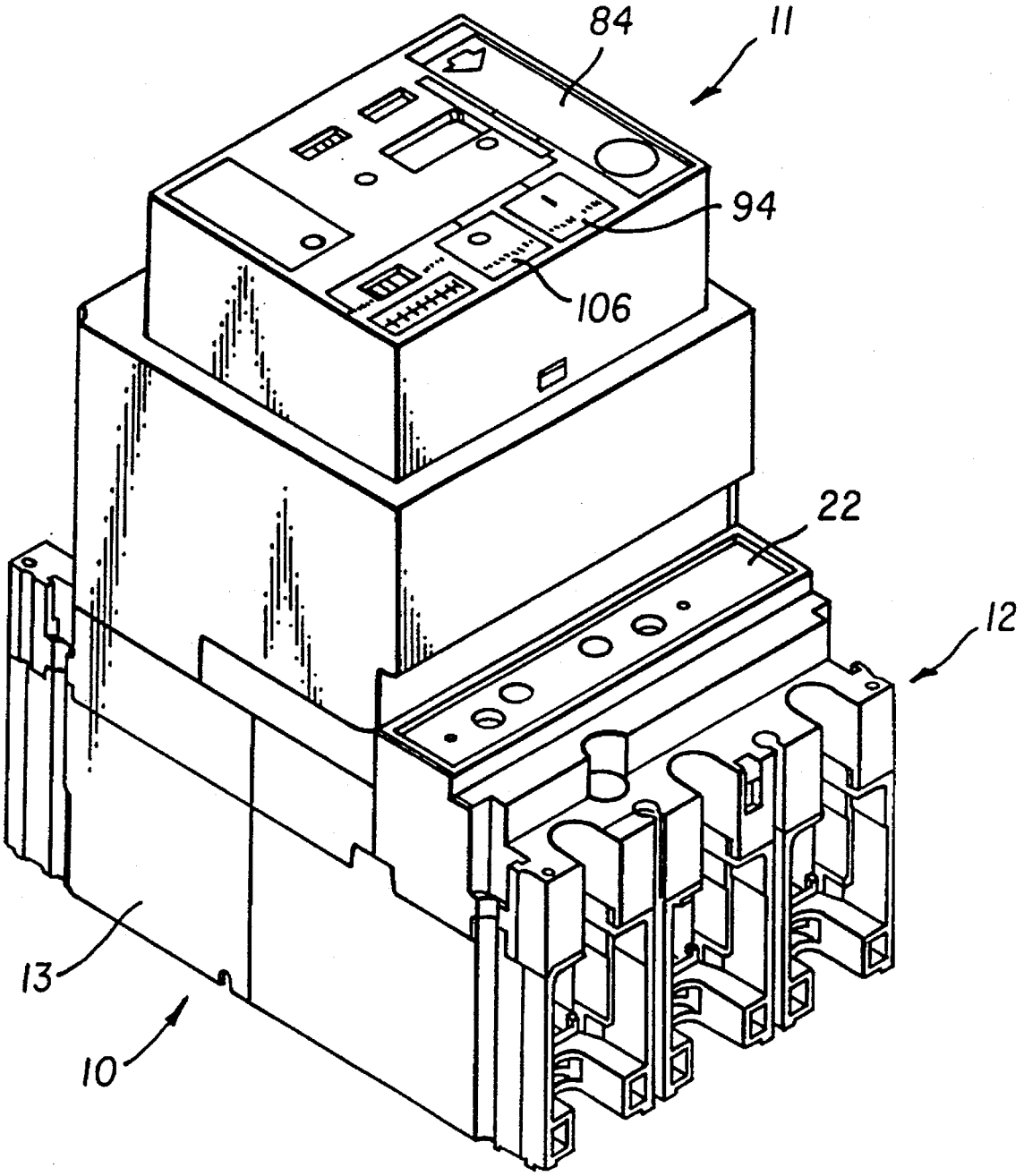
FIG. 1 is a perspective view of a remote controlled circuit breaker according to the invention.

FIGS. 1 and 6 to 9 show a remote controlled circuit breaker 10 formed by assembly of an energy storage remote control unit 11, and a circuit breaker 12 with molded insulating case 13. The circuit breaker 12 is of the multipole type housing a system of separable contacts 14 (FIGS. 6 and 8), whose movable contact 16 of each pole is positioned in an orifice of the switching bar 18.

The bar 18 is actuated by a first operating mechanism 20 controlled by a trip device 22 sensitive to an overload current, and cooperating with a pivoting handle 24 protruding out from the case 13. The trip device 22 can be electronic or magnetothermal. A tripping latch 26 (FIGS. 8 and 9) is pivotally mounted on a fixed spindle 28, and is equipped with a latching surface 30 cooperating in the locked position with a locking bolt 32 articulated on a spindle 34. The locking bolt 32 is held in the locked position by a latch 6 in the shape of a half-moon, controlled by the trip device 2 in such a way as to bring about automatic opening of the circuit breaker when a fault occurs. The latch 26 is linked to the bar 18 by a toggle (not represented), and the handle 24 can occupy three distinct positions comprising:

a first closed position (FIGS. 7 and 8) corresponding to closing of the contacts system 14, and to extension of the toggle following operation of the remote control unit 11 after receipt of a closing order;

a second open position corresponding to opening of the contacts system 14 following operation of the remote control unit 11 after receipt of an opening order;

a third tripped position (not represented) corresponding to separation of the contacts 14 following breaking of the toggle after release of the latch 26 by the locking bolt 32 following a tripping order sent by the trip device 22.

The contacts system 14 comprises for example a double-break rotary contact bridge 16 cooperating with a pair of stationary contacts 38, 40, as described in the document FR-A-2,622,347 filed by the applicant. It is quite clear that any other device, notably of the single-break type, can be used.

Figure 2:
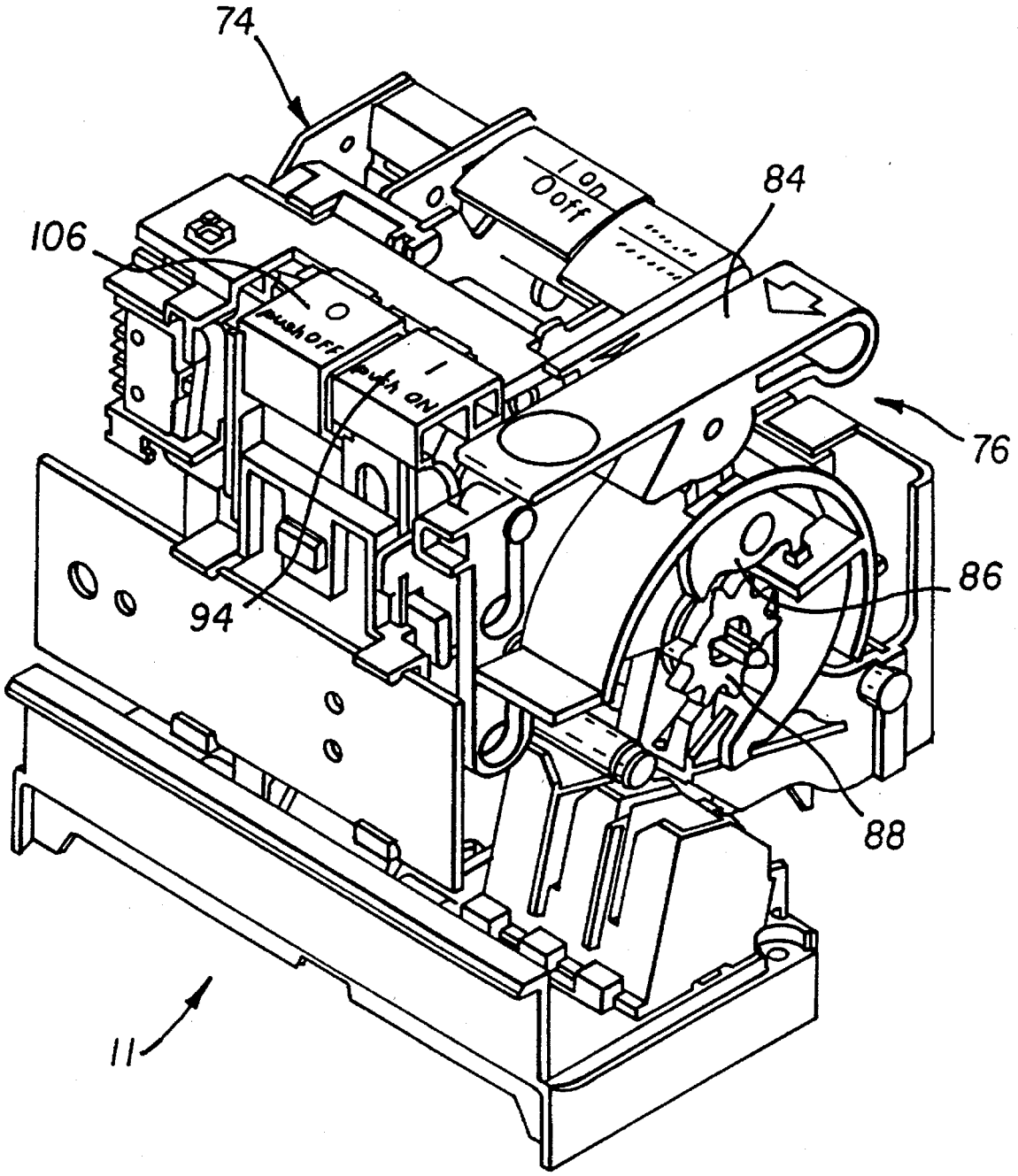
FIGS. 2 and 3 show two perspective views from the right and left of the remote control unit according to the invention.
Figure 3:
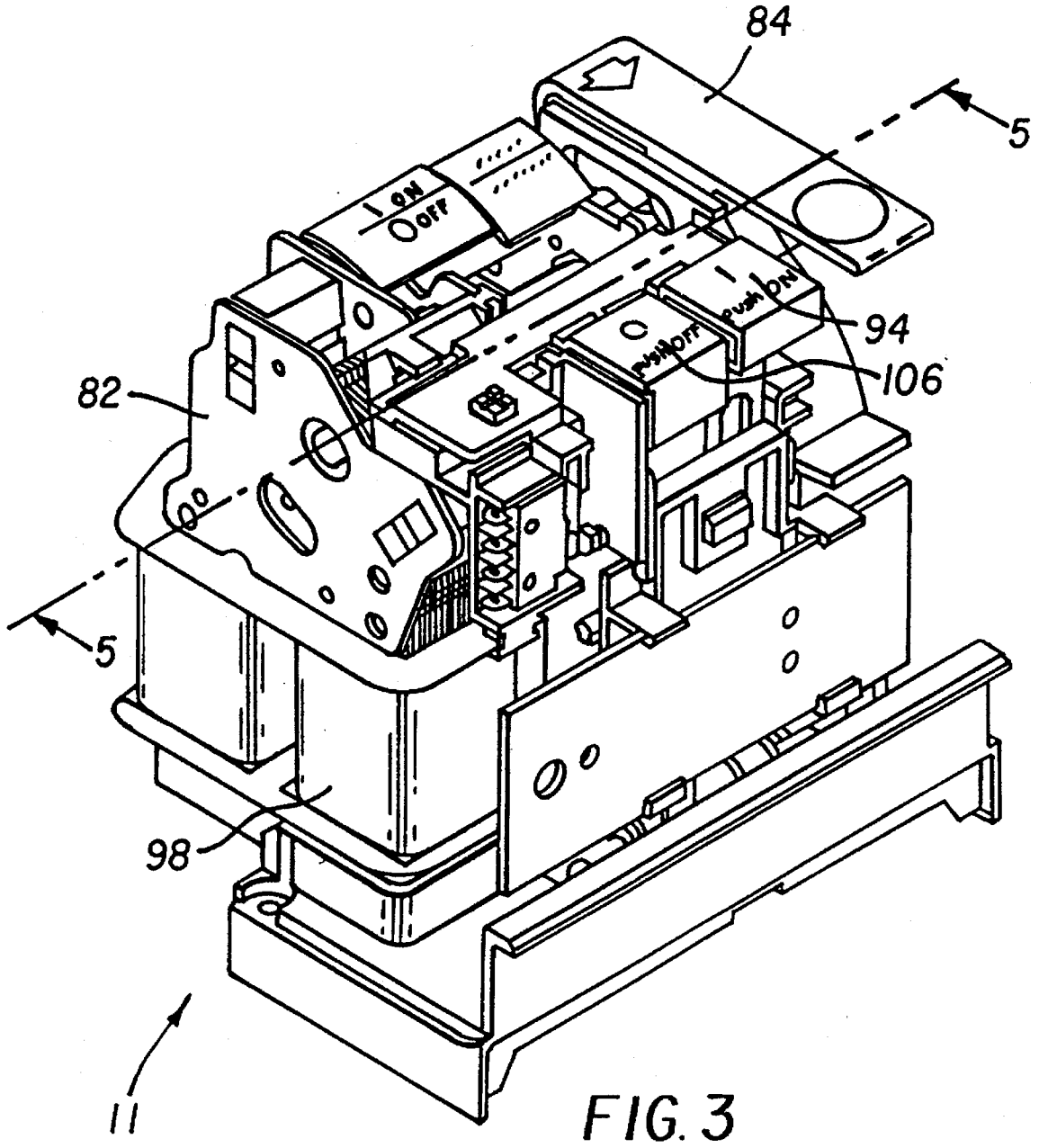

The remote control unit 11 (FIGS. 2 and 3) is formed by an add-on module, fitted to the front panel of the circuit breaker 12 after a front cover has been removed.

Inside the remote control unit 11 there is a second mechanism 42 arranged between two supporting plates 44, 46, extending parallel to one another in the center part of the unit. The mechanism 42 is provided with an energy storage system 48 comprising a closing spring 50 mounted on a telescopic support 52 arranged between a fixed stop 54 and a transmission finger 56 of a drive lever 58. An energy storage system 48 of this kind is described for example in the document EP-A-222,645.

The drive lever 58 is pivotally mounted on a spindle 60 securedly united to the plates 44, 46, and is equipped opposite from the spindle 60 with a drive pin 62 designed to come into engagement with the handle 24 to perform closing of the contacts 38, 40, 16 of the circuit breaker 12. The mechanism 42 comprises in addition a recharging cam 64 mounted on a transverse transmission shaft 66 extending perpendicularly to the plates 44, 46 and drive lever 58. The recharging cam 64 cooperates with a roller 68 mounted with free rotation on the drive lever 58. The profile of the cam 64 presents a first sector 70 for charging the closing spring, and a second sector 72 for releasing the roller 68 enabling a high-speed clockwise pivoting movement of the drive lever 58 due to the relaxation action of the closing spring 50.

Figure 5:
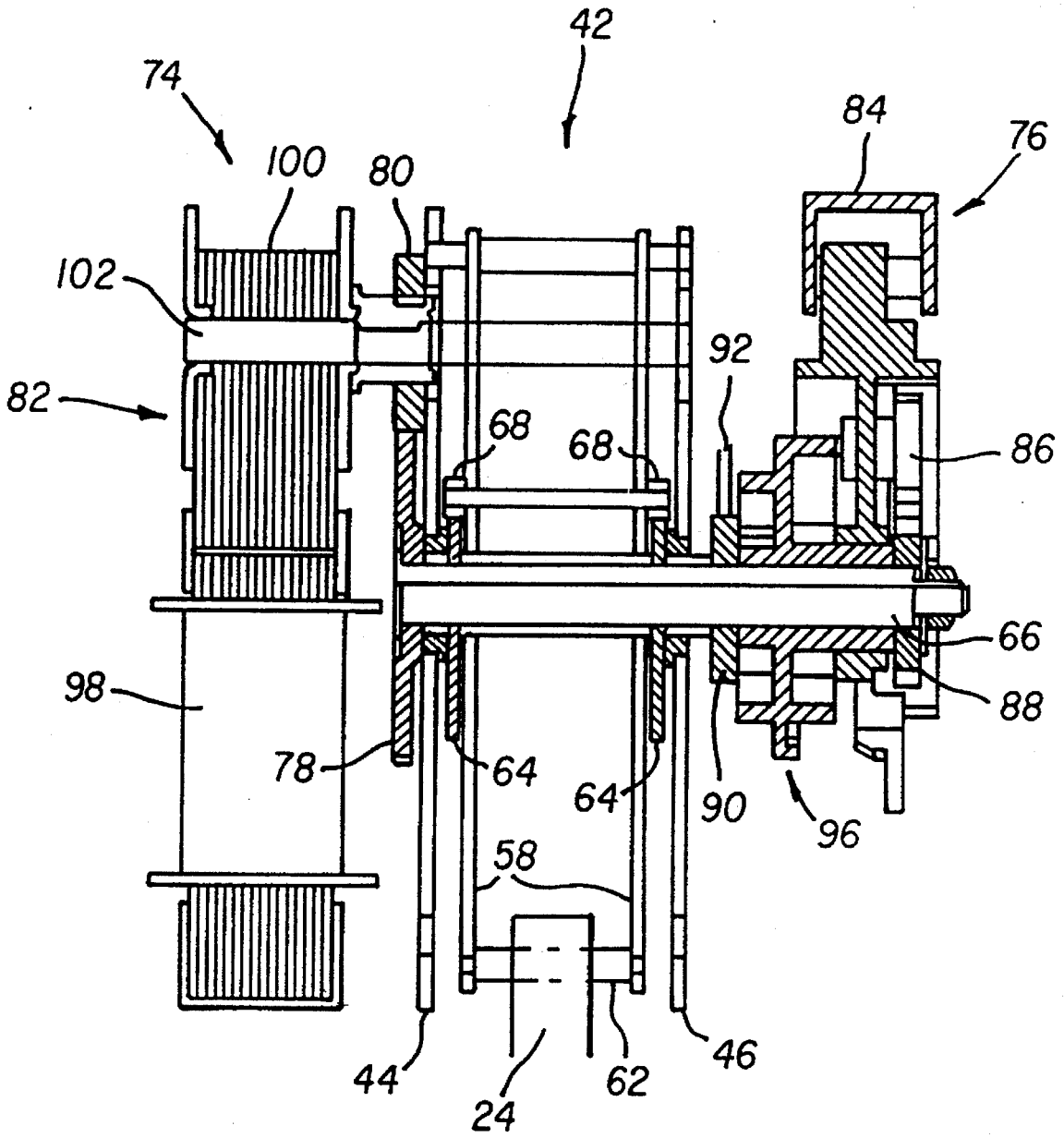
FIG. 5 is a cross-sectional view of the second mechanism along the line 5—5 of FIG. 3.

The second mechanism 42 is located between a geared motor device 74 (on the left in FIG. 5) and an emergency manual control 76 (on the right in FIG. 5). One of the ends of the transmission shaft 66 is connected to a first cog-wheel 78 cooperating by engaging with a second cog-wheel 80 driven by the motor 82. The second cog-wheel 80 has a diameter smaller than that of the first cog-wheel 78 to form a speed reducing stage. The other end of the shaft 66 is securedly united to the manual control 76 comprising an operating lever 84 with alternate movement associated with a ratchet 86 in engagement with a third cog-wheel 88 of the shaft 66.

On the shaft 66 there is also mounted a first auxiliary cam 90 for closing control designed to cooperate with a drive lever 92 by means of a first closing pushbutton 94. The first auxiliary cam 90 and drive lever 92 are appreciably in the same plane, being located between the supporting plate 46 and a second auxiliary cam 96 for control of a signalling contacts system (not represented).

The motor 82 advantageously comprises an electromagnet 98 with a U-shaped magnetic circuit equipped with two excitation coils, and an armature 100 mounted with oscillation on a spindle 102 and cooperating with a unidirectional free-wheel transmission system (not represented), transforming the vibration movement of the armature 100 into a progressive or step-by-step rotational movement of the second cog-wheel 80. A motor of this kind is described for example in the document FR-A-2,654,254. It is clear that any other type of motor can be used to drive the shaft 66 in the same direction of rotation.

Figure 4:
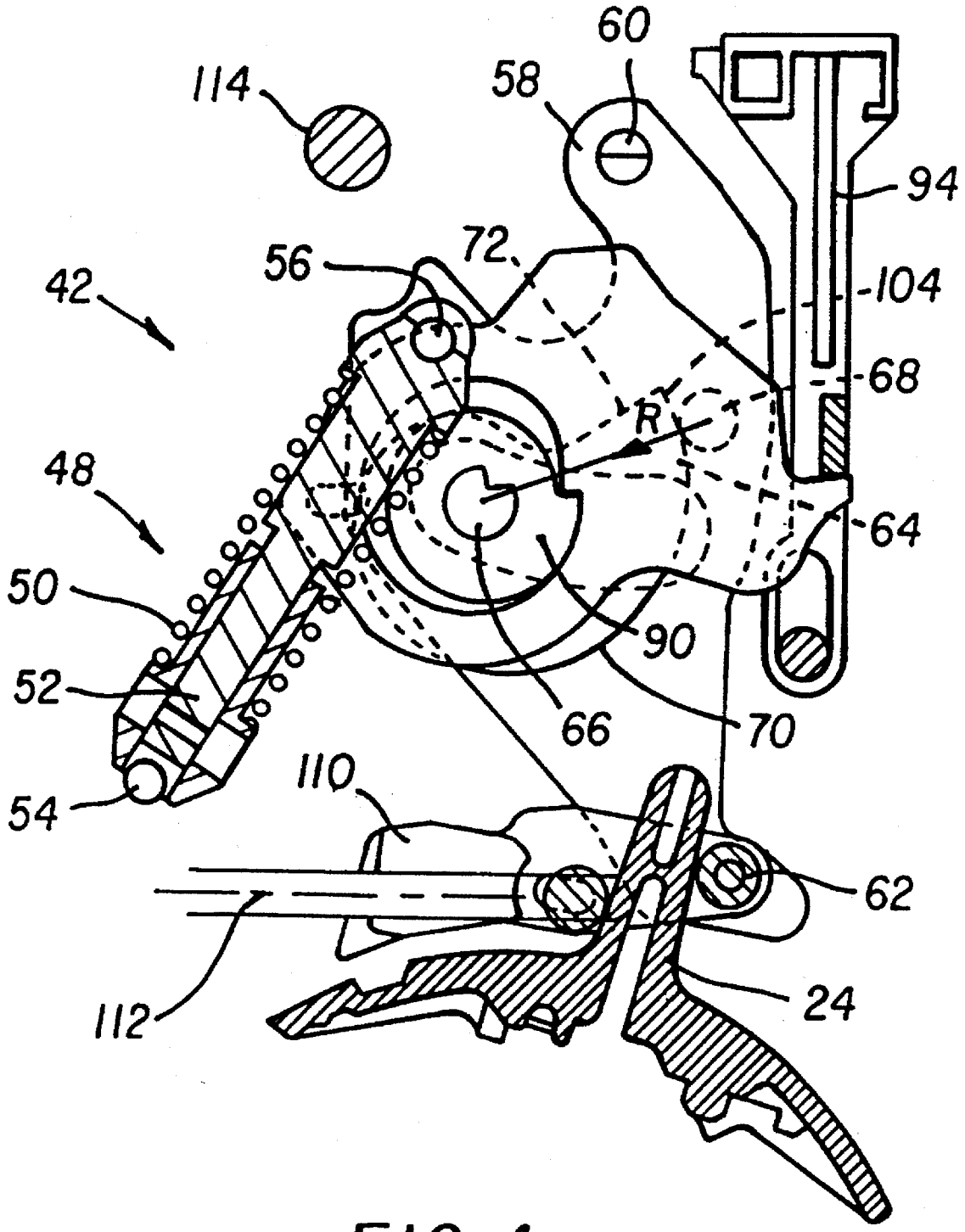
FIG. 4 is a schematic elevational view of the second mechanism of the remote control unit, represented in the charged position.

The recharging cam 64 is provided with a third bearing surface 104 arranged between the first sector 70 and the second sector 72 to hold the roller 68 stable in the charged position of the second remote control mechanism 42. The shape of the bearing surface 104 is appreciably flat, or slightly curved in the form of a dish, and the line of action of the reaction R (FIG. 4) of the roller 68 on the bearing surface 104 passes in the charged position via the spindle 66 of the cam 64. The reaction force R is appreciably perpendicular to the bearing surface 104, and does not generate any torque tending to disrupt the state of equilibrium of the cam 64 and drive lever The second mechanism 42 is in addition equipped with a second opening pushbutton 106 (FIGS. 8 and 9) cooperating with a tripping pushrod 108 of the latch 36 of the first mechanism 20. The pushrod 108 is located between the half-moon of the latch 36 and the bottom end of the pushbutton 106.

The handle 24 of the circuit breaker is engaged in a slide rack 110 mounted with free translation in straight slides 112 of the two supporting plates 44, 46. The rack 110 is urged by the pin 62 of the drive lever 58 between the open and closed positions of the handle 24.

Figure 9:
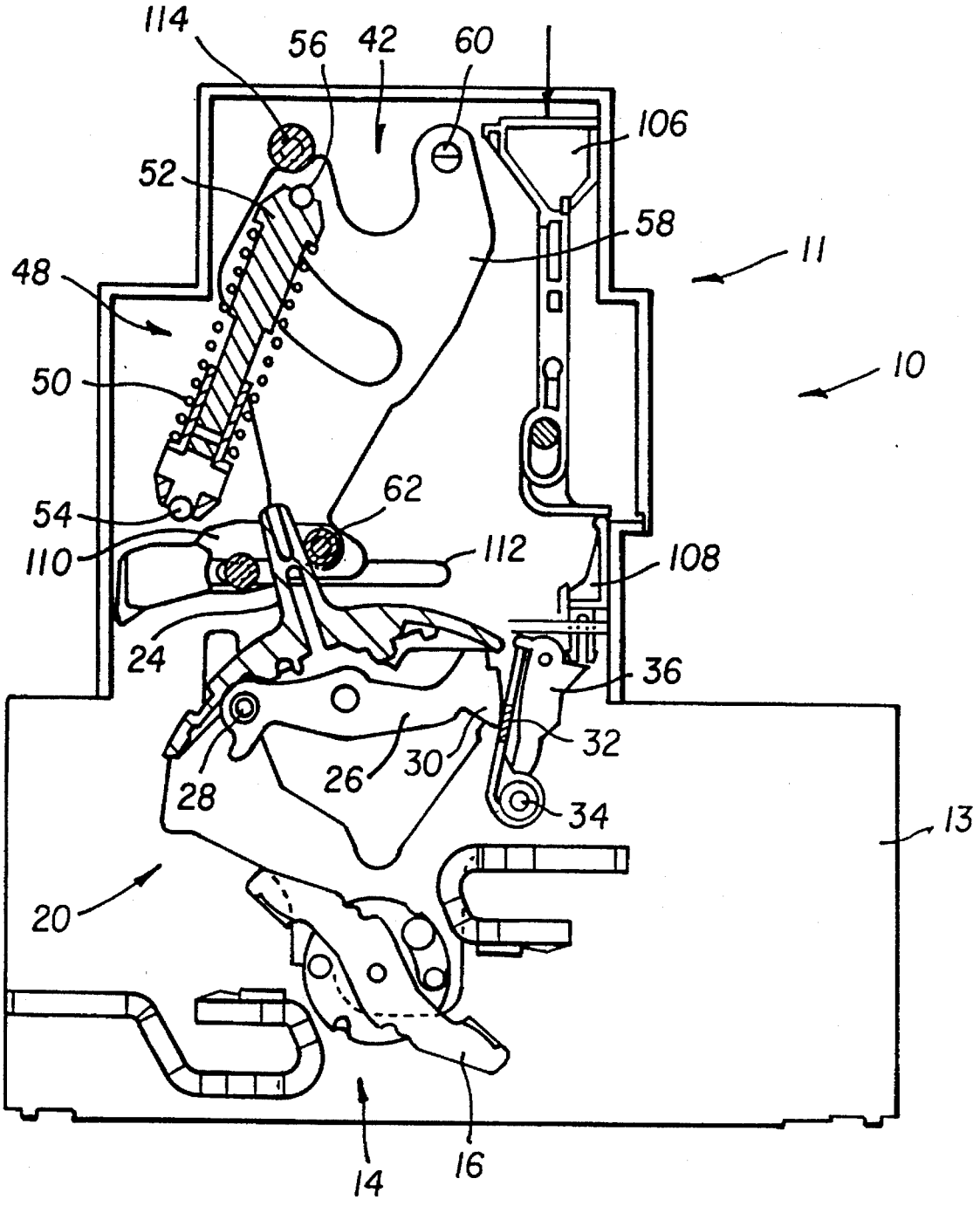

Operation of the remote controlled circuit breaker 10 is as follows:

FIG. 9 shows the circuit breaker in the tripped open position, and the remote control unit 11 in the discharged state. Unlocking of the locking bolt 32 by the latch 36 causes the contacts system 14 to open, but the handle 24 remains immobilized by the drive lever 58 and the rack 110 in the left-hand position corresponding to the closed position. Releasing of the locking bolt 32 takes place in FIG. 9 by a manual order by depressing the second opening pushbutton, which acts on the tripping pushrod 108. The releasing movement of the locking bolt 32 can also be brought about automatically, either by the trip device 22 if a fault is detected or by a remote tripping auxiliary of the MX shunt type (not represented). The spring 50 of the energy storage system 48 is relaxed, and the drive lever 58 is bearing against an end-of-travel stop 114.

From the position in FIG. 9 it is possible after releasing the pushbutton 106 to reset the remote control unit 11 either automatically by an excitation order transmitted to the motor 82 or manually by an alternate pumping movement of the operating lever 84 integrated in the emergency control 76. The main tranmission shaft 66 always rotates in the same direction whatever the drive mode chosen.

The recharging cam 64 rotates clockwise with the shaft 66, and the first sector 70 cooperates with the roller 68 driving the drive lever 58 counterclockwise around the spindle 60, so as to perform compression of the closing spring 50. The stop of the cam 64 operates when the roller 68 is in contact with the bearing surface 104, after the drive lever 58 has simultaneously moved the handle 24 of the circuit breaker 12 to the open position by means of the slide rack 110.

Figure 6:
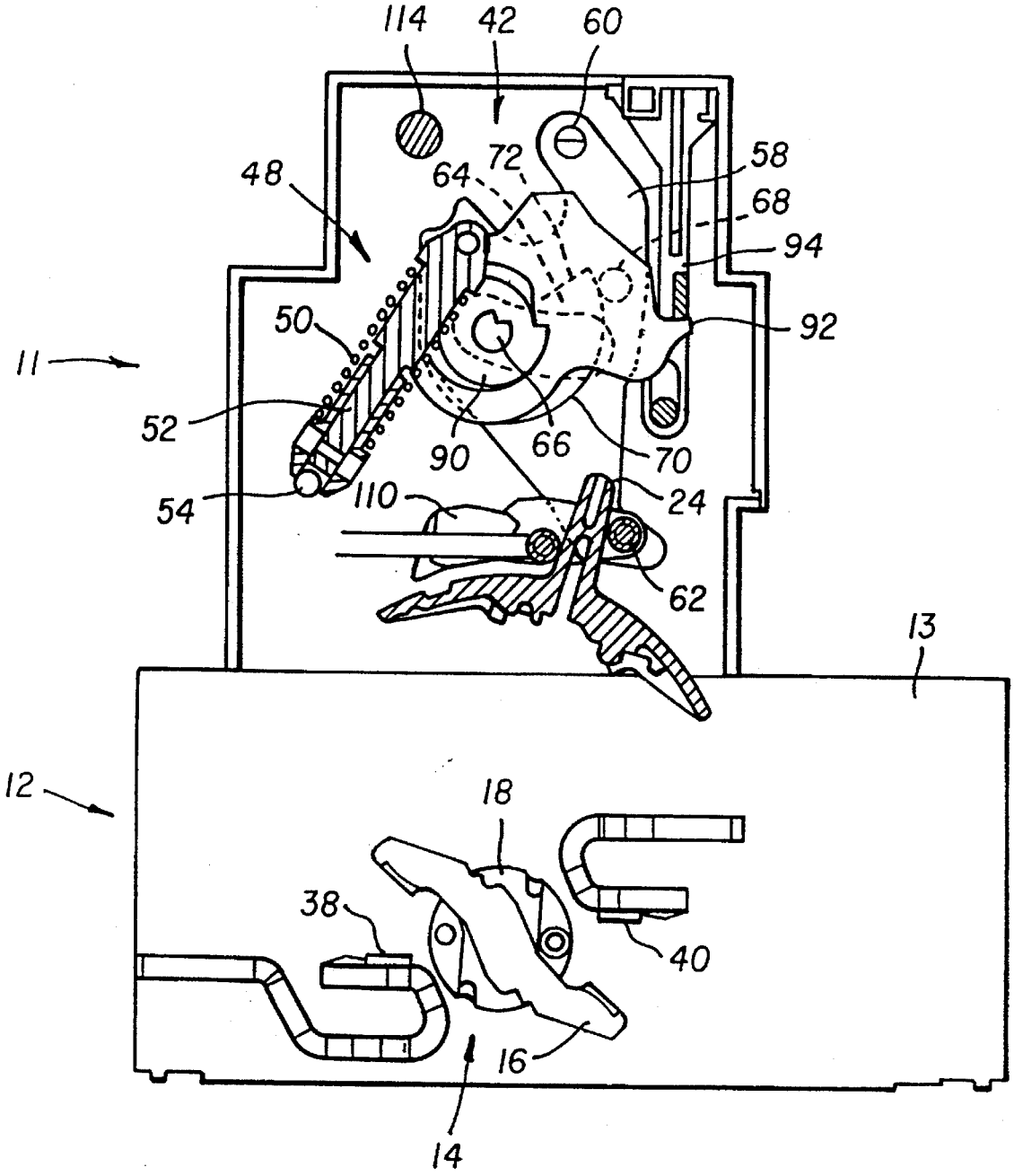
FIG. 6 shows the circuit breaker in the open position, and the remote control in the charged state, with no action on the closing pushbutton.

In the position of FIG. 6, the circuit breaker 12 is in the open position, and the remote control unit 11 is in the charged state. Interrupting the power supply to the vibrating motor 82 enables an instantaneous stopping of the charging cam 64 to be obtained when the roller 68 reaches the bearing surface 104. No driving force is exerted on the cam 64 in this equilibrium position which remains stable, in spite of the absence of an auxiliary latching stage, due to the passage of the reaction R of the roller 68 via the spindle 66 of the recharging cam 64.

Figure 7:
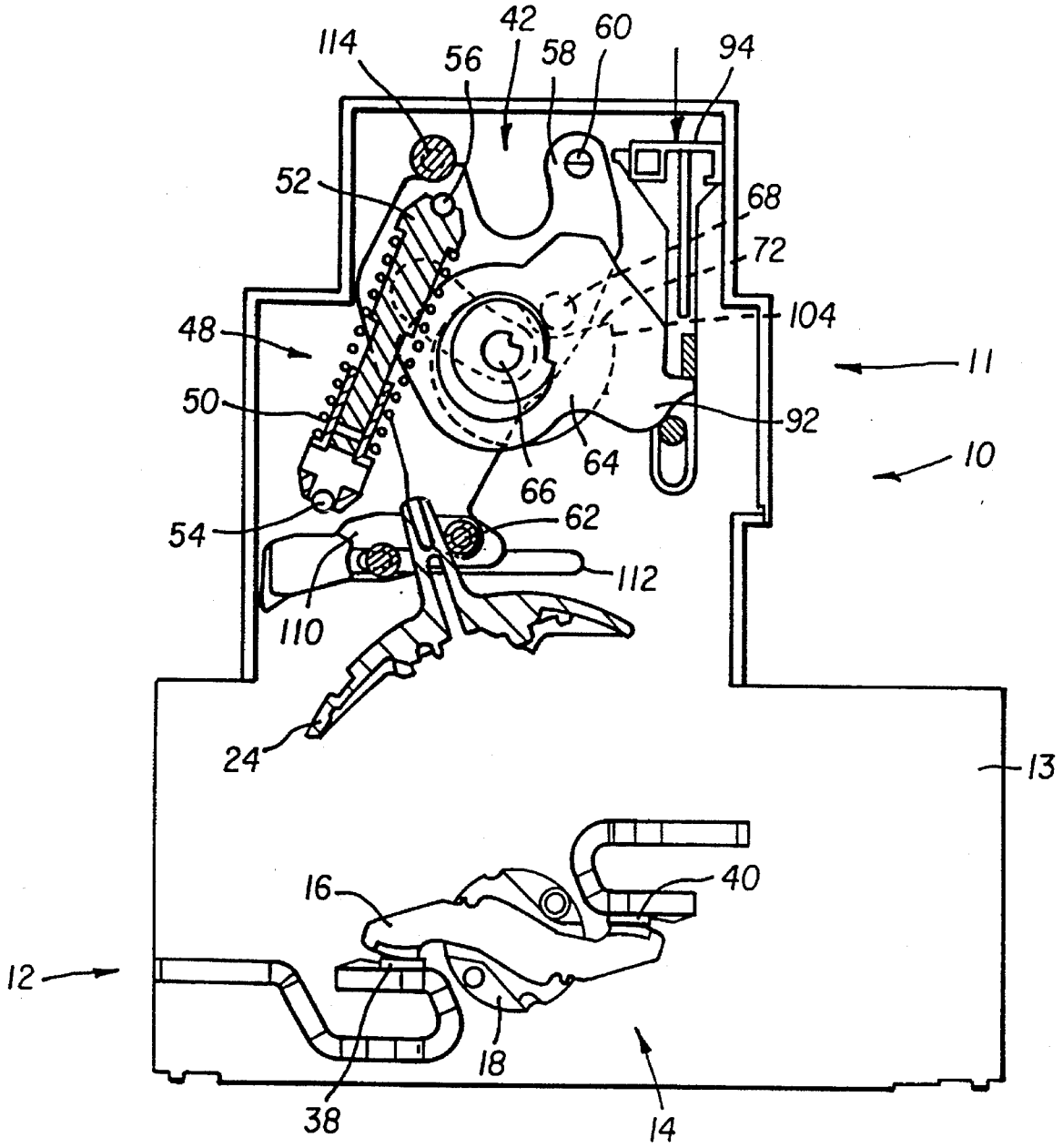
FIG. 7 represents the circuit breaker in the closed position, and the remote control in the discharged state after the closing pushbutton has been depressed.

From the position of FIG. 6, depressing the first closing pushbutton 94 moves the recharging cam 64 in clockwise rotation, by means of the drive lever 92 of the first auxiliary cam 90. The roller 68 leaves, the bearing surface 104, and reaches the second sector 72, enabling relaxation of the energy storage spring 50, and high-speed closing of the contacts of the circuit breaker 12 due to the action of the drive lever 58 (see FIG. 7). The drive pin 62 moves the handle 24 to the left corresponding to the closed position. In FIG. 7, the circuit breaker 12 is closed, and the remote control unit 11 is discharged.

Figure 8:
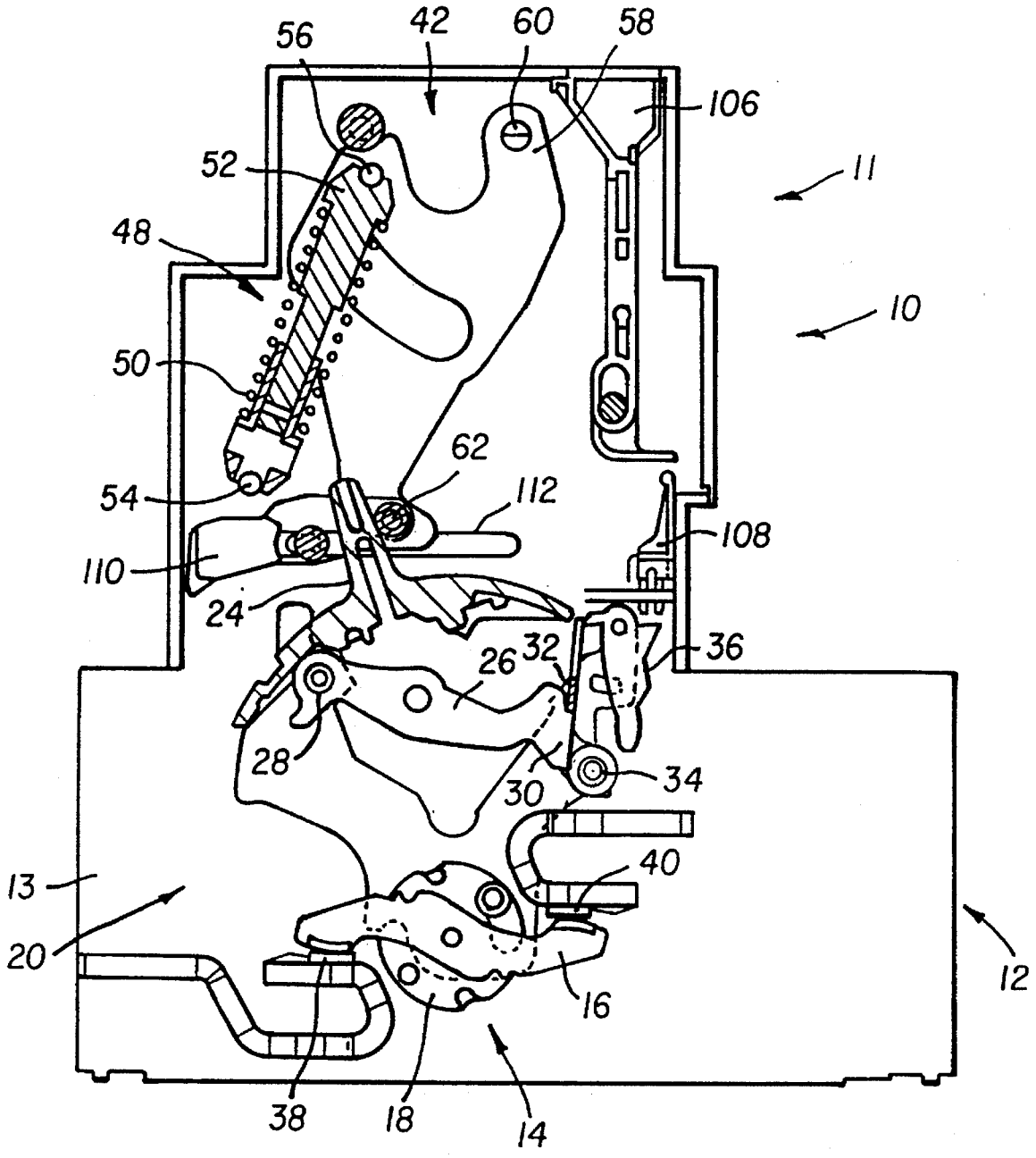
FIGS. 8 and 9 are similar views to FIGS. 6 and 7, respectively before and after action on the opening pushbutton.

The state of the switchgear in FIG. 8 corresponds to that of FIG. 7, after the first closing pushbutton 94 has been released. In this position, it is possible to transit to the state of FIG. 9, after actuating the second opening pushbutton 106.

It is also conceivable from the position of FIG. 7 to recharge the remote control unit 11 and open the circuit breaker 12 by exciting the motor 82 or by a manual action of the emergency control 76.

It can be noted that opening of the circuit breaker, and energy storage in the spring 50 are achieved by the relative positions of the recharging cam 64 and of the roller 68 of the drive lever 58, the cam 64 being actuated electrically by the geared motor device 74, or manually by the emergency control 76. High-speed closing of the circuit breaker 12 results from passing the hangup point of the roller 68 on the recharging cam, which is actuated electrically by the geared motor device 74 or manually by depressing the closing pushbutton 94.

We claim:

1. A remote controlled circuit breaker, comprising:

a circuit breaker unit including an insulating case having a front panel, said insulating case enclosing separable contacts which are actuated by a rotatable switching bar, and an operating mechanism connected to the switching bar to open and close the separable contacts, the operating mechanism including an operating handle extending through the front panel of the insulating case; and a remote control unit adapted to be secured on the front panel of the circuit breaker, comprising a transmission rack which engages the handle and a remote control mechanism connected to the transmission rack, said remote control mechanism including:

a drive lever coupled to the transmission rack, said drive lever having a roller secured thereto;

a closing spring connected to the drive lever to store energy therein; and a recharging cam secured to a rotatable transmission shaft and having a contour against which said roller of said drive lever bears, said recharging cam being driven by one of a geared motor device and manual control device thereby driving the roller and biasing the closing spring, said contour having a first charging sector wherein said spring is biased via movement of the roller therealong, a second stable sector providing a stable position for the roller wherein a line of force of the roller against the recharging cam passes through the transmission shaft, and a release point at which said roller is released.

2. The remote controlled circuit breaker of claim 1, wherein the drive lever is pivotally mounted on a spindle supported by two supporting plates, said drive lever comprises a transmission finger on which the closing spring is articulated, and the contour of the recharging cam sequentially includes said first charging sector, said second stable sector, and said release point.

3. The remote controlled circuit breaker of claim 1, wherein the second stable sector is substantially flat.

4. The remote controlled circuit breaker of claim 1, wherein said second stable sector is curved.

5. The remote controlled circuit breaker of claim 1, wherein said remote controlled circuit breaker includes the geared motor device, said geared motor device including an electric motor connected to one end of the transmission shaft via a speed reducer.

6. The remote controlled circuit breaker of claim 5, wherein said remote controlled circuit breaker includes the emergency manual control device, said emerging manual control device being secured to a second end of the transmission shaft.

7. The remote controlled circuit breaker of claim 5, wherein said electric motor includes an excitation electromagnet and an oscillating armature, to provide stepwise rotational movement of the transmission shaft.

8. The remote controlled circuit breaker of claim 1, further comprising a manual closing pushbutton cooperable with closing means for biasing the recharging cam such that the roller passes the release point thereby providing high-speed relaxation of the closing spring.

9. The remote controlled circuit breaker of claim 8, wherein said closing means comprises an auxiliary cam keyed onto the transmission shaft and an intermediate drive lever connected thereto which is driven by said manual closing pushbutton.

10. The remote controlled circuit breaker of claim 1, further comprising a manual opening pushbutton, wherein said operating mechanism includes a push-rod, said manual opening pushbutton actuating the push-rod to open the separable contacts.

* * * * *